US006478559B2

(12) United States Patent
Bishop et al.

(10) Patent No.: US 6,478,559 B2
(45) Date of Patent: Nov. 12, 2002

(54) BALANCED VANE PUMP

(75) Inventors: Leonard F. Bishop, Sterling Heights, MI (US); Roger Wayne Gettel, Bloomfield Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/768,103

(22) Filed: Jan. 23, 2001

(65) Prior Publication Data

US 2002/0122735 A1 Sep. 5, 2002

(51) Int. Cl.[7] ..... F03C 2/00
(52) U.S. Cl. ..... 418/133; 418/259; 418/209
(58) Field of Search ..... 418/133, 259, 418/209

(56) References Cited

U.S. PATENT DOCUMENTS

| | | | | |
|---|---|---|---|---|
| 3,792,936 A | * | 2/1974 | Pettibone et al. | 418/133 |
| 4,347,047 A | | 8/1982 | Shiowaza et al. | |
| 4,347,048 A | | 8/1982 | Kawabata et al. | |
| 4,373,871 A | | 2/1983 | Christ | |
| 4,416,598 A | | 11/1983 | Merz | |
| 4,496,288 A | | 1/1985 | Nakamura et al. | |
| 4,505,655 A | | 3/1985 | Honaga et al. | |
| 5,111,660 A | | 5/1992 | Gettel | |
| 5,147,183 A | | 9/1992 | Gettel | |
| 5,192,196 A | | 3/1993 | Gettel | |
| 5,267,840 A | | 12/1993 | Snow et al. | |
| 5,290,155 A | | 3/1994 | Snow et al. | |
| 6,149,409 A | | 11/2000 | Palakodati et al. | |

FOREIGN PATENT DOCUMENTS

| | | | | |
|---|---|---|---|---|
| JP | 57-070988 | * | 5/1982 | 418/259 |
| JP | 59-215981 | * | 12/1984 | 418/259 |
| JP | 01-195984 | * | 8/1989 | 418/133 |

* cited by examiner

*Primary Examiner*—Thomas Denion
*Assistant Examiner*—Theresa Trieu
(74) *Attorney, Agent, or Firm*—Brinks Hofer Gilson & Lione

(57) ABSTRACT

A balanced rotary vane pump for a motor vehicle power steering system includes a rotor having fifteen vanes disposed in a three lobe cam ring. Three inlet ports and three outlet ports disposed in equally spaced pairs provide fluid communication to the three lobes of the cam ring. Because the subject vane pump provides a significantly larger number of pump pulses per revolution which are more closely spaced in time and may define smaller volumes, the pulsatile nature of the output and thus vibration as well as the excitation of sympathetic vibration is greatly reduced.

15 Claims, 4 Drawing Sheets

BALANCED VANE PUMP

BACKGROUND OF THE INVENTION

1. Field of the Invention

The invention relates generally to vane pumps and more specifically to a balanced vane pump for automotive power steering systems having a three lobe cam ring and three pairs of inlet and outlet ports.

2. Description of Related Art

Vane pumps typically used in vehicular power steering systems in automobiles, sport utility vehicles, pickup trucks and the like represent a significant source of noise because they provide a pulsatile output. Such a rippling or pulsing output interacts with the hydraulic circuit to create harmonic pressure pulsations which may be characterized as fluid borne noise. Currently utilized balanced vane pumps have two inlet ports and two outlet ports disposed in diametrically opposed pairs. So configured, a completely hydraulically balanced device is achieved. That is, for every force and compressive action occurring at one specific circumferential location or vane on the rotor, the same force or action is occurring at a diametrically opposed location. Generally speaking therefore, the forces in the pump and particularly those against the rotor and vanes relative to the axis of rotation of the rotor cancel each other.

A conventional power steering pump has ten vanes and a rotor which rotates within a cam ring having two oppositely disposed lobes. A pumping region or volume is formed between any two adjacent vanes twice in each revolution, which allows each pumping volume to pump twice per revolution. There are, thus, twenty flow pulses generated per revolution, which represent potential sources of noise.

With increased emphasis on reducing noise, vibration and harshness (NVH) in motor vehicles, all operating systems and components have come under scrutiny. Components of power steering systems which are typically hydraulic and energized by a rotary vane pump have been included in such examination. The present invention relates to such a device.

SUMMARY OF THE INVENTION

A balanced rotary vane pump for a motor vehicle power steering system includes a rotor having fifteen vanes disposed in a three lobe cam ring. Three inlet ports and three outlet ports disposed in equally spaced pairs provide fluid communication to the three lobes of the cam ring. Because the subject vane pump provides a significantly larger number of pump pulses per revolution which are more closely spaced in time and may define smaller volumes, the pulsatile nature of the output and thus vibration as well as the excitation of sympathetic vibration is greatly reduced.

It is thus an object of the present invention to provide a rotary vane pump having three equally spaced pumping lobes in a cam ring and three pairs of inlet and outlet ports.

It is a further object of the present invention to provide a rotary vane pump for vehicular power steering systems having reduced noise output.

It is a still further object of the present invention to provide a balanced rotary vane pump having fifteen vanes disposed in a three lobe cam ring.

It is a still further object of the present invention to provide a rotary vane pump for motor vehicle power steering systems which provides a higher number of pumping pulses per revolution of the rotor than currently available units, thus reducing noise generation.

Further objects and advantages of the present invention will become apparent by reference to the following description of the preferred embodiment and appended drawings wherein like reference numbers refer to the same component, element or feature.

DESCRIPTION OF THE PREFERRED EMBODIMENT

Figure 1:
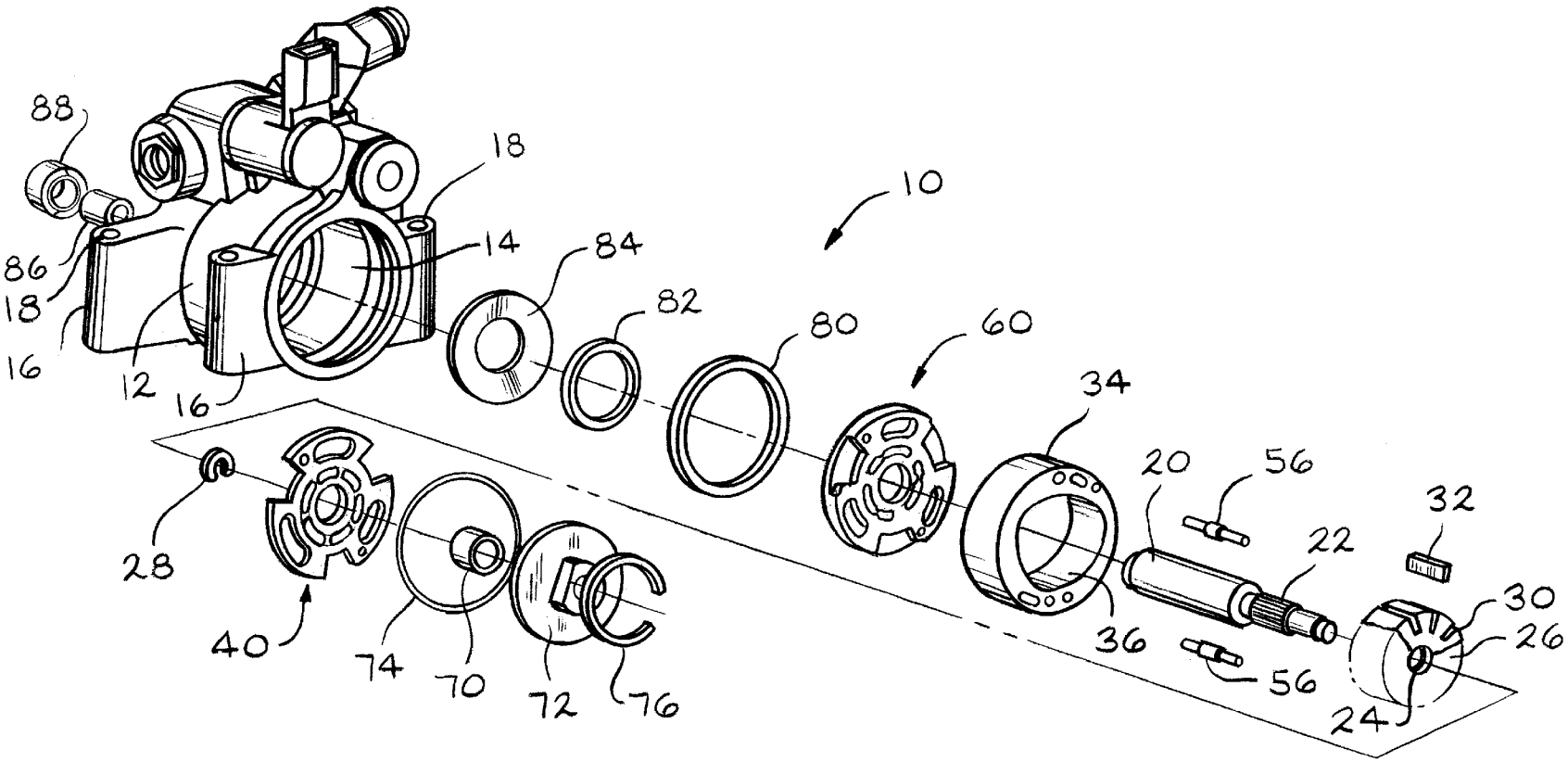
FIG. 1 is an exploded perspective view of a three lobe balanced rotary vane pump according to the present invention.
Figure 2:
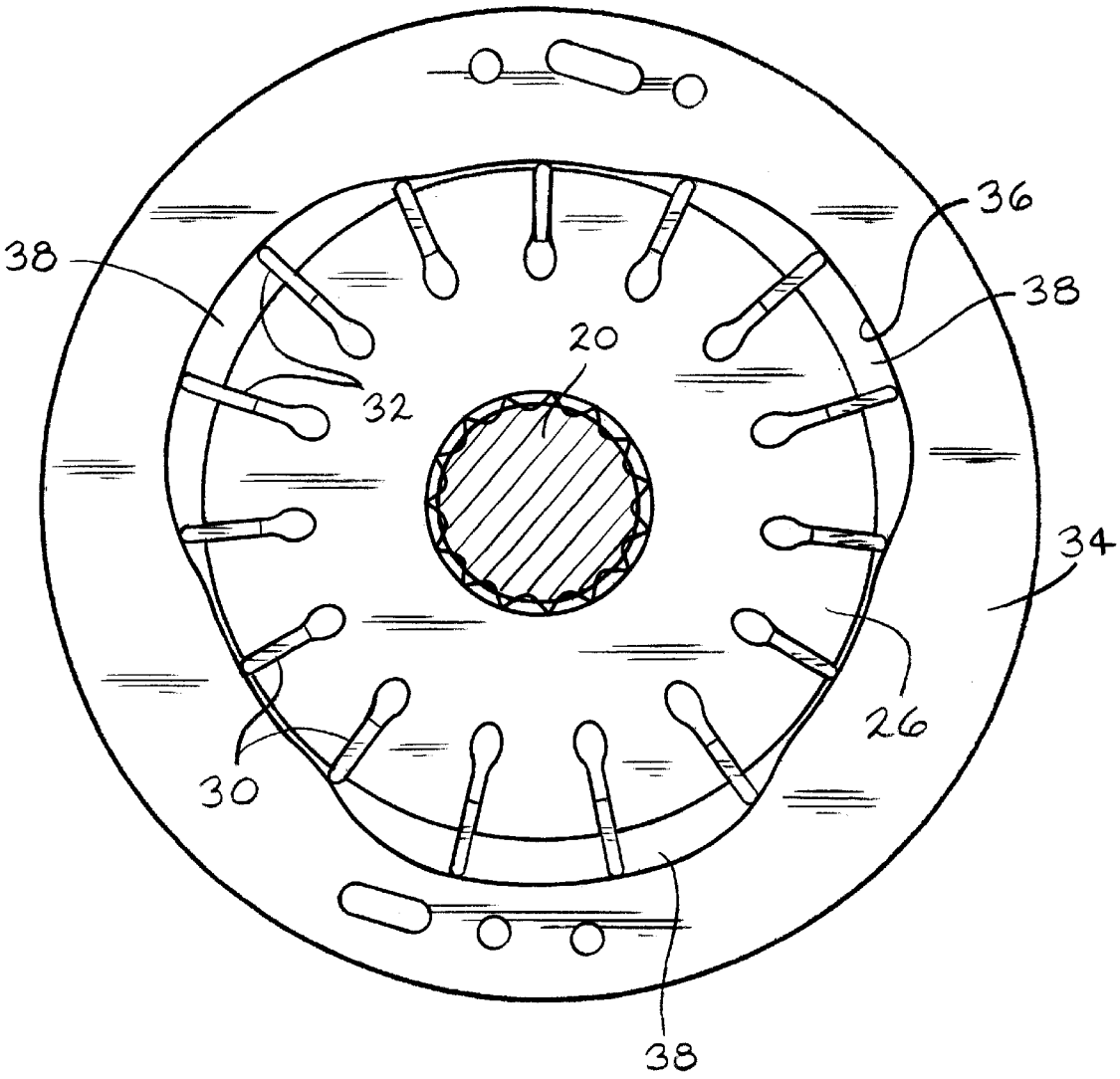
FIG. 2 is a cross-sectional view of a cam ring and rotor of a three lobe balanced rotary vane pump according to the present invention.

Referring now to FIGS. 1 and 2, a three lobe balanced rotary vane hydraulic power steering pump according to the present invention is illustrated and generally designated by the reference number 10. The pump 10 includes a housing 12 defining a cylindrical region 14 containing the mechanical components of the pump 10. The housing 12 also includes at least three bosses 16 defining through apertures 18 each adapted to receive a mechanical attachment device such as a bolt (not illustrated) which can be threaded into an engine block (also not illustrated) to secure the housing 12 thereto. So configured, the conventional bracket typically used to support a power steering pump can be eliminated.

Centrally received within the circular region 14 and supported for rotation therein is a shaft 20 which extends out the front of the pump 10 and receives a pulley (not illustrated) which is driven by an engine belt (also not illustrated). The shaft 20 include male splines 22 which engage female splines 24 within a rotor 26. The rotor 26 is fixed in position on the shaft 20 by a snap ring 28. The rotor 26 defines fifteen equally spaced radial slots 30 which each receive a blade or vane 32. The rotor 26 and vanes 32 are received within a cam ring 34 having an undulating inner surface 36 which defines three lobes 38.

Figure 3:
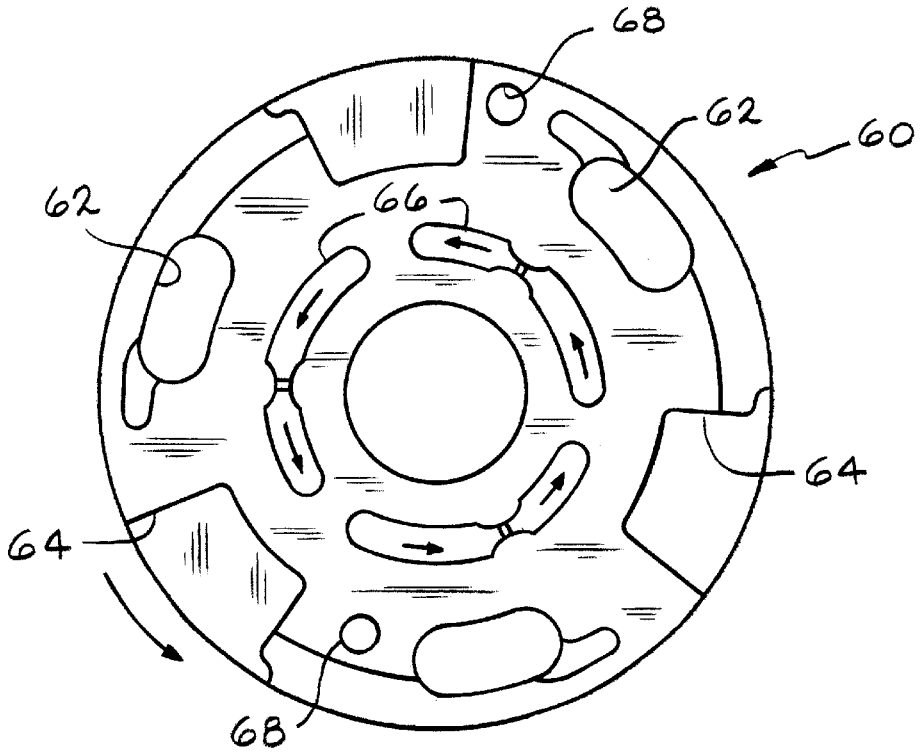
FIG. 3 is an end view of a lower pressure plate of a three lobe rotary vane pump according to the present invention showing the relative positions of the inlet and outlet ports.
Figure 4:
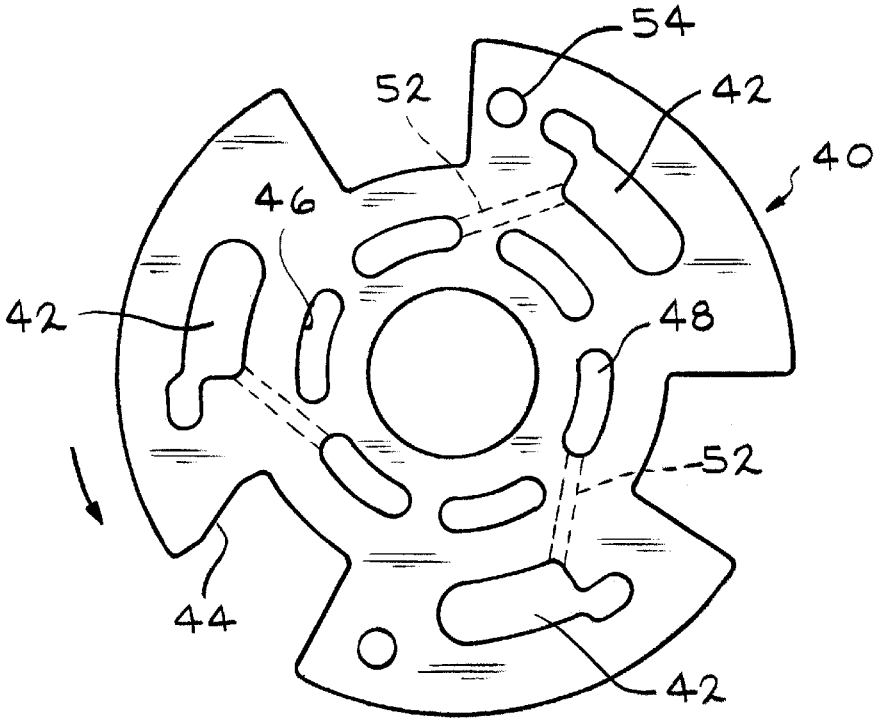
FIG. 4 is an end view of the upper pressure plate showing the relative angular positions of the inlet and outlet ports.

Referring now to FIGS. 1, 3 and 4, disposed at each end of the cam ring 34 and also received within the cylindrical region 14 of the housing 12 is a first or upper pressure plate 40 and a second or lower pressure plate 60. The upper pressure plate 40 includes three arcuate outlet ports 42 which communicate with passages in the housing 12 as well as arcuate passageways 46 which assist in cold start priming of the pump 10. Additional groups of passages 48 are coupled to the outlet port through passages 52. The upper pressure plate 40 also includes a pair of diametrically opposed through openings 54 which receive a pair of axially disposed alignment pins 56.

Disposed adjacent the opposite end of the cam ring 34, the lower pressure plate 60 includes three equally spaced outlet ports 62, three equally spaced inlet ports 64, and three arcuate, diametrically opposed channels 66 located radially and angularly at positions which facilitate communication with terminal holes at the radial base of the slots 30 in the rotor 26. The lower pressure plate 60 also includes a pair of diametrically opposed through passages 68 which receive the alignment pins 56. One or more registration lugs (not illustrated) project from the back face of the lower pressure plate 60 and engage complementarily configured recesses in the interior of the housing 12. Cooperation between the lugs and recesses inhibits rotation of the lower pressure plate 60 and the alignment pins 56 maintain the cam ring 34 and the upper pressure plate 40 in proper alignment and inhibit rotation thereof.

Adjacent the front or upper pressure plate 40 is an upper or outer bushing 70 which supports the shaft 20 for rotation on its axis. The bushing 70 is supported by a pump cover 72. An O-ring seal 74 is disposed between the cover 72 and the housing 12 and a wire snap ring 76 retains the cover 72 in secure, fluid-tight disposition within the housing 12.

Adjacent the lower pressure plate 60 is an inner seal 80 and an outer seal 82. A Belleville spring 84 develops an axial force between the inner surface of the housing 12 and the various components within the pump 10 and forces them into proximity to minimize fluid leakage therebetween. A bushing 86 is supported within the housing 12 and rotatably supports the shaft 20 and a shaft seal 88 prevents loss of hydraulic fluid from the interior of the pump 10.

Figure 5:
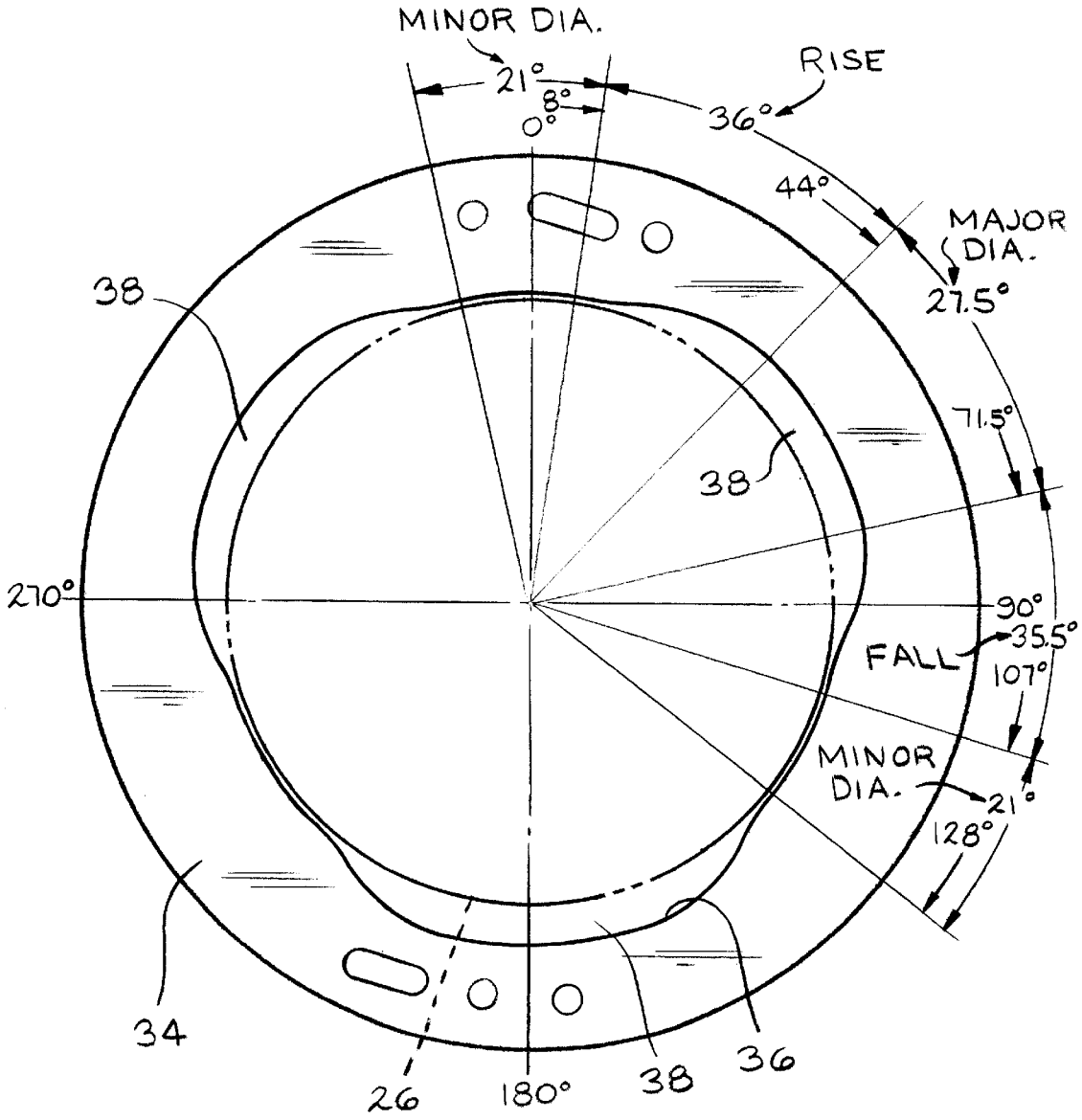
FIG. 5 is a schematic, cross-sectional view of a cam ring and rotor of a three lobe balanced rotary vane pump according to the present invention illustrating a preferred profile of the cam ring surface.

Referring now to FIG. 5, a schematic illustration of a preferred profile of the interior surface 36 of a cam ring 34 according to the present invention which defines three pumping lobes 38 is illustrated. As shown in FIG. 5, beginning 8° clockwise from a 0° reference point, the surface 36 begins 36° of rise to a point 44° clockwise of the 0° reference point. The major diameter of the lobe 38 then dwells for 27.5°. At 71.5° from the 0° reference point, the surface 36 falls for 35.5° to an angular position 107° from the 0° reference point. The cam surface 36 then dwells at a minor diameter for 21° extending to 128° from the 0° reference. Note that the rise, fall and dwells extend over exactly 120°. The cam ring 34 defines two additional lobes 38 about the remaining 240°.

In operation, a three lobe, balanced vane pump according to the present invention provides greatly reduced flow pulsations and thus reduces sympathetic vibration of the components such as hoses and mechanical components of the power steering system resulting in reduced noise, vibration and harshness of the overall power steering system.

Pumping volume, that is, pump displacement of vane pumps is given by the following formula:

$$Q = \frac{B_{pf} \times N_v \times V_v \times N_p}{1000}.$$

In this equation Q is the pump output in liters per minute, $B_{pf}$ equals the balanced pump factor, $N_v$ equals the number of vanes, $V_v$ equals the volume between adjacent vanes in milliliters and $N_p$ equals pump rpm. In conventional ten vane pumps, the balanced pump factor ($B_{pf}$) equals two and the number of vanes ($N_v$) is ten.

The same equation applies to the three lobe, balanced vane pump 10 of the present invention. However, the number of vanes ($N_v$) increases to fifteen and the balanced pump factor ($B_{pf}$) is three. Accordingly, it will be readily appreciated that rather than twenty pulses per revolution generated in a conventional ten vane, two lobe pump the three lobe, balanced vane pump of the present invention produces forty-five flow pulses. The pulses are thus more closely spaced in time and depending upon the geometry of the cam ring 34, may be of slightly smaller magnitude. Both of these factors reduce pulsations and thus sympathetic vibration and provide improved NVH performance of the pump 10, specifically, and the entire power steering system, generally.

The foregoing disclosure is the best mode devised by the inventors for practicing this invention. It is apparent, however, that apparatus incorporating modifications and variations will be obvious to one skilled in the art of rotary vane pumps. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. A rotary vane pump comprising, in combination, a first pressure plate defining three inlet ports, a second pressure plate defining three outlet ports, a cam ring disposed between said pressure plates and defining a chamber having three circumferentially spaced regions of large diameter and three circumferentially spaced regions of small diameter alternating with said three large diameter regions;

at least two aligned axial openings in said pressure plates and cam ring and at least two alignment pins disposed in respective said axial openings, a shaft extending through said cylindrical region of said housing, a rotor disposed within said chamber and driven by said shaft, said rotor having first and second end faces disposed adjacent a respective one of said first and second pressure plates and defining a plurality of axially extending slots and a plurality of vanes disposed in said slots.

2. The rotary vane pump of claim 1 further including a housing defining a cylindrical region adapted to receive said pressure plates and said cam ring.

3. The rotary vane pump of claim 1 further including shaft seals disposed on said shaft.

4. The rotary vane pump of claim 1 further including bushings for rotatably supporting said shaft.

5. The rotary vane pump of claim 1 wherein said rotor includes female splines and said shaft includes male splines.

6. The rotary vane pump of claim 1 wherein said rotor includes fifteen said slots.

7. A rotary vane hydraulic pump comprising, in combination, a housing defining a cylindrical region, a first pressure plate defining three inlet ports, a second pressure plate defining three outlet ports, a cam ring disposed between said pressure plates and defining a pumping chamber having three equally circumferentially spaced regions of a first diameter and three equally circumferentially spaced regions of a second diameter smaller than said first diameter alternating with said three first diameter regions;

at least two aligned axial openings in said pressure plates and cam ring and at least two alignment pins disposed in respective said axial openings, a shaft extending through said cylindrical region of said housing, a rotor disposed within said pumping chamber and coupled to said shaft for rotation therewith, said rotor having first and second end faces disposed adjacent a respective one of said first and second pressure plates and defining a plurality of axially extending slots; and a plurality of vanes disposed in respective ones of said slots.

8. The rotary vane hydraulic pump of claim 7 further including shaft seals disposed on said shaft.

9. The rotary vane hydraulic pump of claim 7 further including bushings for rotatably supporting said shaft.

10. The rotary vane hydraulic pump of claim 7 wherein said rotor includes female splines and said shaft includes male splines.

11. The rotary vane hydraulic pump of claim 7 wherein said rotor includes fifteen of said axially extending slots.

12. The rotary vane hydraulic pump of claim 7 wherein each complete rotation of said rotor provides 45 fluid pulses.

13. A balanced rotary vane hydraulic pump comprising, in combination, a housing defining a cylindrical opening, a first pressure plate defining three arcuate inlet ports, a second pressure plate defining three arcuate outlet ports, a cam ring disposed between said pressure plates and defining a pumping chamber having three equally circumferentially spaced regions of a first diameter and three equally circumferentially spaced regions of a second diameter smaller than said first diameter alternating with said three first diameter regions;

a shaft extending through said cylindrical region of said housing, at least two aligned axial openings in said pressure plates and cam ring and at least two alignment pins disposed in respective said axial openings, a rotor disposed within said pumping chamber and coupled to said shaft for rotation therewith, said rotor having first and second end faces disposed adjacent a respective one of said first and second pressure plates and defining a plurality of axially extending slots; and a plurality of vanes disposed in respective ones of said slots.

14. The balanced rotary vane pump of claim 13 wherein said rotor includes fifteen of said axially extending slots.

15. The balanced rotary vane pump of claim 13 wherein said rotor includes female splines and said shaft includes male splines.

* * * * *